US005992323A

United States Patent [19]

Eltgen

[11] Patent Number: 5,992,323

[45] **Date of Patent: *Nov. 30, 1999**

[54] PRINTING PROCESS EMPLOYING REMOVABLE ERASABLE IMAGE PORTIONS

[75] Inventor: Jean-Jacques Eltgen, Danjoutin, France

[73] Assignee: Nipson, Belfort, France

[ * ] Notice: Under 35 U.S.C. 154(b), the term of this patent shall be extended for 695 days.

[21] Appl. No.: 08/505,650

[22] Filed: Jul. 21, 1995

Related U.S. Application Data

[63] Continuation of application No. 08/181,434, Jan. 14, 1994, abandoned.

[30] Foreign Application Priority Data

Jan. 14, 1993 [FR] France ..... 93 00301

[51] Int. Cl.[6] ..... B41N 1/08; B41C 1/10

[52] U.S. Cl. ..... 101/463.1; 101/458; 101/467; 101/478; 101/425; 101/487

[58] Field of Search ..... 101/135–137, 101/140–142, 144, 145, 174, 177, 211, 450.1–452, 463.1, 465–467, 425, 478, 483, 487–489, DIG. 37, DIG. 48; 346/74.2, 74.5, 74.7

[56] References Cited

U.S. PATENT DOCUMENTS

| | | | |
|---|---|---|---|
| 4,395,946 | 8/1983 | Price | 101/211 |
| 4,718,340 | 1/1988 | Love, III | 101/141 |
| 4,846,065 | 7/1989 | Mayrhofer et al. | 101/467 |
| 5,072,671 | 12/1991 | Schneider et al. | 101/467 |
| 5,129,321 | 7/1992 | Fadner | 101/467 |
| 5,213,041 | 5/1993 | Kanck | 101/450.1 |
| 5,293,817 | 3/1994 | Nüssel et al. | 101/450.1 |
| 5,317,970 | 6/1994 | Nüssel et al. | 101/467 |
| 5,351,617 | 10/1994 | Williams et al. | 101/462 |

FOREIGN PATENT DOCUMENTS

| | | | |
|---|---|---|---|
| 0512549 | 11/1992 | European Pat. Off. . | |
| 0522804 | 1/1993 | European Pat. Off. . | |
| 2349443 | 11/1977 | France . | |
| 3911932 | 10/1990 | Germany . | |
| 134242 | 6/1988 | Japan | 101/466 |
| 135248 | 6/1988 | Japan | 101/136 |
| 151456 | 6/1988 | Japan | 101/450.1 |
| 48949 | 2/1990 | Japan | 101/465 |

*Primary Examiner*—Stephen R. Funk
*Attorney, Agent, or Firm*—Kerkam, Stowell, Kondracki & Clarke, P.C.; Edward J. Kondracki

[57] ABSTRACT

The invention relates to a printing process, such as lithographic printing, that requires a printing press and a colorant vehicle. To enable constituting and rapidly removing motifs to be transferred to a printing medium, a hardenable material having good affinity for the colorant vehicle is deposited automatically and directly onto a device that cannot be dismantled or detached from the press, i.e., is part of the press, and that is constituted of a material having an opposite affinity, so as to constitute the motifs to be transferred to the medium. The material constituting the device is such that the material can be removed rapidly when the motifs are to be changed, and is such that new motifs can be constituted there immediately after the removal of those preceding them.

26 Claims, 3 Drawing Sheets

PRINTING PROCESS EMPLOYING REMOVABLE ERASABLE IMAGE PORTIONS

This is a continuation of application Ser. No. 08/181,434, filed Jan. 14, 1994 now abandoned.

FIELD OF THE INVENTION

The invention relates to a printing process, such as lithographic or offset printing or the like, requiring a printing press and a colorant vehicle such as ink or paint. It also relates to a press for implementing the process.

BACKGROUND OF THE INVENTION

Printing techniques using a press, such as lithographic printing, allow high printing speeds, associated with excellent image quality.

In lithographic printing, accordingly, an image made up of a text or texts or a design or designs on paper or on any other usable printing medium is obtained with the aid of a printing press, which makes it possible to apply to the medium the inked image, reproducing motif previously carried on at least one printing plate. The printing plate is made outside the press from a flexible material, such as a sheet of aluminum, employing a photoengraving process, for instance. This operation consists on the one hand of making zones on the plate outside the press corresponding to an image that is to be obtained on the paper these zones having an affinity for the liquid colorant vehicle (printing ink) that will be used for printing, and on the other hand, zones that have no affinity whatever with the colorant vehicle.

A printing press generally includes the following:

one or more plate cylinders, around each of which a printing plate is mounted and fixed after it has been engraved;

in proximity with each plate cylinder, a blanket, constituted by a cylinder encompassed by a material having an affinity for the ink used, and arranged to be capable of being put in contact with the motif of the plate during the printing operation, enabling the rotational motion of the plate to be transmitted to the blanket, causing a transfer of the ink from the image zones of the plate to the blanket and;

means for putting the printing medium into contact with each blanket and driving this medium at the same speed as the peripheral speed of the blanket.

The printing phase per se consists of inking the plate, with the ink remaining solely on the zones with which it has an affinity, and setting the assembly into motion.

The ink is then transferred from the image zones of the plate to the blanket, and then from the blanket to the printing medium.

The plate thus constitutes an intermediate transfer element. Known techniques use oleaginous inks: The image zones of the plate are oleophilic and hence hydrophobic; the non-image zones of the plate are hydrophilic and hence oleophobic; finally, the material encompassing the blanket is hydrophobic. In the case where an oleaginous ink is used, water or a wetting solution is also placed on the plate and spreads over the hydrophilic zones, preventing the ink from spreading there. As a consequence of the hydrophobia of the blanket, only the ink is transferred from the plate to the blanket and hence to the printing medium.

This technique also enables polychrome printing on the same medium, by using for example inks that lend themselves to subtractive synthesis of the colors (yellow, cyan, magenta).

Nevertheless, this technique is expensive, time-consuming, and troublesome; accordingly, it can be applied only to very long printing runs.

Making a plate is relatively time-consuming and requires a set of complex tools that must be employed prior to the printing phase.

Moreover, printing a monochrome, multi-page piece of work requires the preparation of as many plates as there are pages in the work. Finally, producing a polychrome piece of work is even more complex, because for each polychrome page a plurality of plates must be prepared in order to obtain all the shades desired on this page, with each plate including different motifs each corresponding to one different basic shade of the image. Hence using inks that lend themselves to subtractive synthesis of colors (yellow, cyan, magenta) requires that at least three plates be prepared: one for yellow, one for cyan, one for magenta, and even a fourth for black, which is very difficult to obtain by subtractive synthesis.

The technique using four plates is known as quadricolor printing. The motifs on each plate are determined for instance by a colorimetric analysis of the original, when the process involves a reproduction.

Once each plate is ready, each one has to be mounted and fixed with extreme precision on a different plate cylinder, so that the successive passage of the medium past each one, after inking, makes it possible to obtain a perfect image without misregistration of the colors. The finer the details of the definitive image, the more complicated and time-consuming it is to achieve proper registration.

Once the definitive printing run of a page has been completed, the corresponding plate or plates must be unmounted, and then the process has to start again for the other pages. Otherwise, a printing system must be available that has as many presses as necessary, which considerably increases the costs and does not obviate the necessity of mounting and fixing all the necessary plates beforehand.

In U.S. Pat. No. 5,129,321, assigned to Rockwell International Corporation, a lithographic printing system is described and claimed that makes it possible to use one less plate and hence dispense with its positioning and fixing, but nevertheless this system has the disadvantage of not being perfectly adapted to long printing runs.

The invention described in the aforementioned patent, for printing with the aid of a conventional (oleaginous) ink, consists of replacing the assembly constituted by the engraved plate and the plate cylinder by a simple cylinder on whose periphery a layer forming a substrate of powdered oleophobic material is deposited each time a new motif is to be printed; an image corresponding to the motifs to be printed is formed on this layer with the aid of a hardenable oleophilic material. The intermediate transfer element is accordingly constituted by the substrate of oleophobic material and the zones of oleophilic material carried by this layer.

The oleophobic material is preferably magnetic, and the cylinder is magnetizable, such that the layer of this material is held on the periphery of the cylinder, magnetizing the cylinder.

Depositing the oleophilic material, in a configuration corresponding to the motifs to be printed, is done with the aid of an electronic, electromechanical or electromagnetic transfer device. Data representing the motifs to be carried on the layer of oleophobic material are contained in an electronic memory and are utilized so that the transfer device deposits the oleophilic material solely at the required locations on the layer of oleophobic material. In one embodiment described in the aforementioned patent, the oleophilic material used is a magnetic meltable material; its deposition onto the substrate of oleophobic material is done by magnetodeposition on the cylinder, in a manner like the deposition of magnetic toner in magnetographic printers. To that end, magnetic heads are located in proximity with the cylinder, which makes it possible to create zones on the substrate that have a magnetization enabling them to attract the particles of oleophilic material.

After its deposition, the oleophilic material is melted, which makes it possible to harden it, so as on the one hand to prevent the motifs from becoming deformed and on the other to lend it a certain cohesion with the substrate of oleophobic material; the particles of oleophilic material attach to the particles of oleophobic material. To that end, the system described in the aforementioned pattern further includes, in proximity with the periphery of the cylinder, a melting device for fixing the oleophilic material.

The printing is done as on a conventional press: The cylinder, after having been coated with the layer forming the substrate and the motifs, is set into rotation, then wetted and inked, in such a way that the ink spreads over the motifs and the wetting product spreads over the oleophobic zones, and then the ink is transferred to the printing medium (paper or other) by way of a blanket.

Once the desired printing run of an image has been completed, the cylinder is demagnetized, causing the layer forming the substrate to detach spontaneously from the cylinder, carrying with it the hardened motifs of oleophilic material that it carries. If printing of a different image is desired, then a new substrate is made, on which new motifs are carried and hardened. It is accordingly very fast and less expensive than with conventional presses to make up the motifs corresponding to an image and remove them again.

This apparatus lends itself to polychrome printing, to the extent that positioning of the motifs is done automatically, by an electronic device.

However, it requires the deposition of two types of materials: that constituting a substrate and that constituting the motifs. Depositing the substrate has no other function than that of allowing the easy later removal of the motifs by forced detachment from this substrate.

Moreover, it is not entirely well-suited to long printing runs, because the substrate has a tendency to detach spontaneously, at least in certain regions, during the rotation of the carrier cylinder during the printing phases, since it is held merely magnetically. This means that the copies that leave the press must be checked, and the image (substrate and motifs) must be sometimes reconstituted on the periphery of the cylinder during the printing run.

SUMMARY OF THE INVENTION

The object of the invention is to overcome these disadvantages by proposing a printing process that is low in cost yet allows constant quality and the capabilities of lithographic (monochrome or polychrome) printing regardless of the planned printing run, which does not require engraving of a plate to constitute the intermediate element, and which employs means making it possible to form of make and dismantle the intermediate element automatically and rapidly during the printing phases.

According to the invention, a printing process for printing at least one image, in a predetermined printing run, with the aid of a press by transfer of at least one colorant vehicle between an intermediate transfer element and a printing medium, including at least: one phase of automatically making or forming the intermediate transfer element in the press by depositing and fixing a hardenable liquid or powdered material onto a substrate, the substrate and the hardenable material each having a different affinity for the colorant vehicle, such that the intermediate element includes zones having an affinity for the colorant vehicle and zones without affinity for the colorant vehicle; a printing phase; and a phase of dismantling the intermediate transfer element when the desired printing run has been completed is characterized in that it consists of using a device that is non-dismantleable from the press as the substrate, and that the phase of dismantling the intermediate element consists of implementing means enabling the rapid removal of the hardened material from the substrate with the aid of an appropriate operation, the device constituting the substrate being constituted in such a way that the immediate making of a new intermediate transfer element is possible immediately after the removal of the hardenable material when a new image is to be printed.

Since the intermediate transfer element is constituted by fixing the hardenable material directly to a device that is not dismantleable from the press, the motifs to be printed are under no threat of deteriorating in the course of the printing run, which accordingly avoids the disadvantages of the apparatus of the aforementioned U.S. patent. Moreover, the non-dismantleable nature of the device serving as a substrate prevents this device from deteriorating when the hardenable material is removed, it being understood that this is on the condition that the removal phase employs means adapted to the physico-chemical properties of the material constituting this device. Finally, since the constitution or in other words the shape and/or physico-chemical structure of the device constituting the substrate is adapted so that the immediate making of a new intermediate transfer element will be possible immediately after the removal of the hardenable material, no delay whatever is necessary between printing a first image and printing of another once the printing run of the first image has been completed.

In another characteristic of the invention, the removal phase consists of attacking the hardenable material with an appropriate chemical product, the structure of the device constituting this substrate being such that it is unaffected and accordingly is not dismantled by that attack, so that it can without delay serve to make a new transfer element.

In another characteristic, the hardenable material is meltable, and the removal phase consists of causing melting of this material, the structure of the device constituting the substrate being such that it has a low thermal inertia, so that immediately after the melting and removal, this device resumes the temperature that it had prior to that phase enabling the making of a new transfer element without delay.

In a preferred embodiment of the process, more particularly adapted to lithographic printing with the aid of oleaginous inks, the device constituting the substrate is an endless metallic web, put into contact with a hydrophilic blanket, and the hardenable material is a meltable oleophilic powder. A metal is in fact naturally oleophobic (hydrophilic); a metallic web, that is, a device having a slight thickness in proportion to its surface area, accordingly has a low thermal inertia. The use of such web is accordingly entirely suitable for constituting an intermediate transfer element with oleophilic zones (those covered with the hardenable material) and oleophobic zones (the zones on the surface of the web that are not covered) and to enable both the rapid removal of a meltable material deposited onto its surface and without delay putting such a material into place in order to constitute a new image or new motifs.

BRIEF DESCRIPTION OF THE DRAWINGS

Further characteristics and advantages of the invention will become apparent from reading the ensuing description of FIGS. 1–7, which illustrate various embodiments of a printing apparatus enabling the implementation of the invention.

DETAILED DESCRIPTION OF THE PREFERRED EMBODIMENTS

Figure 1:
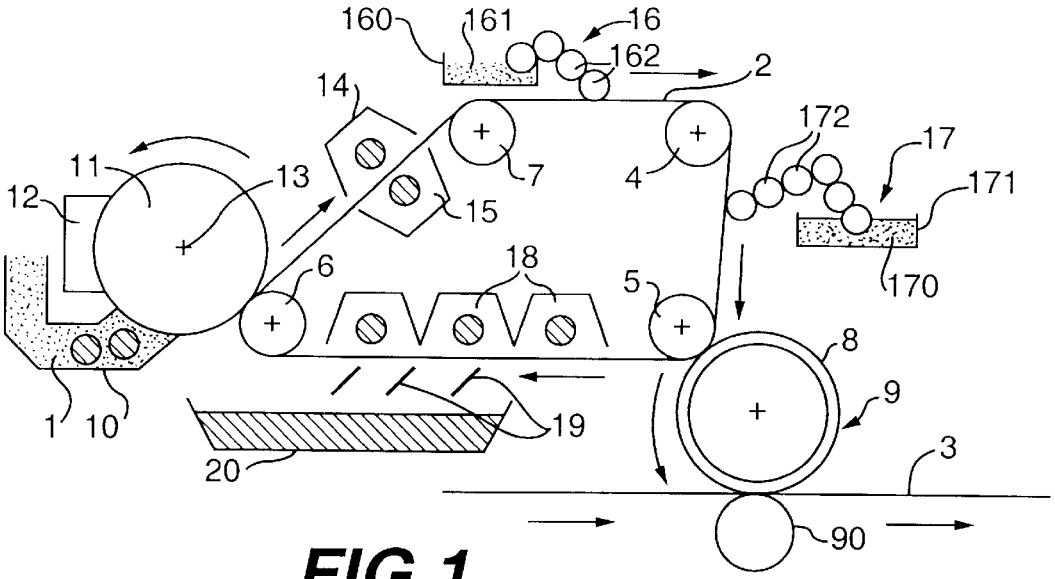
FIG. 1 shows a first embodiment of a press enabling monochrome printing, for instance with the aid of oleaginous ink.

The press shown in this drawing figure makes it possible to deposit a meltable oleophilic material 1 onto an endless metallic (oleophobic) web, in order to constitute the intermediate element having motifs corresponding to an image to be printed onto a printing medium 3, such as paper supplied sheet by sheet or continuously. The endless web, carried on carrier rollers 4, 5, 6, 7, is in contact with the peripheral, oleophilic surface 8 of a cylindrical blanket 9, which in turn is put in a known manner into contact with the printing medium, such as the paper 3, with the aid of an impression cylinder 90.

In the example shown, the oleophilic meltable material 1 is powdered and magnetic; it is contained in a reservoir 10 before its deposition onto the endless web 2. A device for magnetically transferring the meltable oleophilic material 1 from the reservoir to the web is provided. By way of example, it is a device identical to those found in magnetographic printers, that is, constituted by a magnetizable drum 11 and an assembly 12 containing heads for magnetizing the drum 11. In a known manner, heads make it possible to selectively magnetize certain points of the drum 11, and each head can be excited separately, so that it is possible to form a magnetic image with excellent definition on the periphery of the drum 11. Control means, not shown but known per se, enable this selective excitation of the heads.

The drum 11 is disposed in proximity with the reservoir 10, so that when at least one point on its periphery is magnetized, material 1 contained in this reservoir comes to be deposited temporarily on this magnetized point and is disposed in proximity with the metallic web 2 so that the material 1, temporarily deposited on its periphery, will be transferred onto the face of the endless metallic web 2 that is in contact with the blanket 9, so as to reproduce there the image to be printed onto the medium. To that end, the periphery of the drum 11 is in tangential contact with the metallic web 2, such that when the drum 11 rotates about its axis 13 of rotation, the speed of rotation of its periphery corresponds to the speed of displacement of the endless web, and the material 1 is transferred to the metallic web. Hence the dimensions of the endless web 2 should be suitable to permit reproducing there the largest image intended to be printed with the press; that is, the developed length and the width, respectively, of the web 2 should be at least equal to those of this image.

After having been transferred to the metallic web 2, the material 1 is firmly fixed to it. Hence as has already been indicated, this operation makes it possible to prevent the dismantling of the motifs during printing.

In the embodiment illustrated by this FIG. 1, the fixation is done by heating the material and then cooling it. To do so, at least one heating device 14 is provided in proximity with the web 2, taking into account the direction of travel thereof (as illustrated by arrows), so that the material can be fixed immediately after having been deposited, and acts on the entire width of the web and on a small portion of its length.

This device 14 is preferably disposed facing the surface of the web that receives the meltable material 1, so that its action will be as effective as possible. However, as illustrated by this drawing figure, in order for the heating to be even more effective and fast, it is conceivable to dispose at least one other heating device 15, face to face with the first one 14, facing the opposite surface of the web from that that receives the material. It is understood that because of the low thermal inertia of the web, a heated portion thereof cools down as soon as it leaves the zone, whose length is slight, that is heated by the means 14, 15, so that the hardening is very fast.

In a variant, the material used is hardenable and fixable by either natural or forced polymerization, for example by exposing it to ultraviolet light. In that case, the device 14, in other words the device disposed facing the surface of the web that receives the meltable material 1, will be replaced with a suitable radiation source. No source corresponding to the device 15 is then provided face to face with it, since the radiation will be stopped by the web 2.

It is understood that both the magnetic transfer device 11, 12 and the heating devices 14, 15 are put into operation when necessary, that is, during the constitution of the image on the thin web 2. Moreover, means not shown, such as a clutch mechanism, are preferably provided so that the periphery of the drum 11 and the web 2 will be in contact only when it is necessary to transfer material 1 from the reservoir 10 to the web, in order to avoid premature wear to the drum 11 and the web 2.

A known device 16 for wetting and a known device 17 for inking the intermediate transfer device constituted by the (oleophobic) web 2 and the fixed (oleophilic) material are provided. For example, the wetting device 16 includes a supply device, such as a reservoir 160, of wetting product 161, with rollers 162 for transferring the wetting product between the supply device and the intermediate transfer device. Similarly, the inking device includes an ink supply device 170, such as a reservoir 171, and rollers 172 for transferring the ink between the supply device and the intermediate transfer device.

These wetting and inking devices 16 and 17, respectively, are put into operation as soon as the intermediate transfer device is completed, or in other words immediately after the hardenable material 1 has been fixed.

Finally, the press includes a device for removal of material, which is put into service once the printing run of an image has been completed, which makes it possible to dismantle the intermediate transfer device without deteriorating the substrate constituted by the surface of the thin web 2.

In the case of the press illustrated by FIG. 1, which is arranged to function with a meltable material 1, the removal device includes means 18 for remelting the material, such as heating devices, and cleaning means 19 such as scrapers or squeegees, and optionally a reservoir 20 for catching the material. The remelting means 18 and cleaning means 19 are disposed relative to one another and to the web such that the zones that have to be cleaned are heated, so that the material 1 will be at least partially remelted before it undergoes the action of the cleaning means 19, and so that the remelting will continue while the cleaning means are active.

The embodiment of FIG. 1 makes it possible to meet the following constraints: The remelting means 18 are disposed facing the opposite surface of the web from that that receives the material, and the cleaning means 19 are on the side of the surface that supports the material, in such a way as to be face to face with a portion of the remelting means, such that a zone of the press exists where the zones of th e web that are to be cleaned experience the simultaneous action of the remelting means 18 and the cleaning means 19.

The removal device is preferably disposed in such a manner that the action of the cleaning means 19 is facilitated by natural gravity. FIG. 1 shows the way in which th is device must be placed so that this action will be optimal: The cleaning means are positioned in such a way as to act upon a horizontal portion of the web, with the surface to be cleaned facing the ground, so that the material after having been remelted has a tendency to drop spontaneously into the catch reservoir which is then placed below it.

It is understood that other arrangements of the removal device are possible that enable natural gravity to facilitate the cleaning. It suffices for the removal device to act upon a portion of the web that has a more or less major slope oriented toward the ground.

The low thermal inertia of the metallic web has the consequence that as soon as a portion is no longer exposed to the radiation of the remelting device, it cools again quite rapidly, enabling the quasi-immediate constitution of a new intermediate transfer element.

As has been mentioned, instead of performing a thermal attack to remelt the material 1 in order to clean the metallic web 2, with a view to the preparation of a new intermediate transfer element, it is possible to perform a chemical attack, on the condition that the agents chosen do not attack the metallic web. It will be appreciated that this operation is much more complicated, and that the thermal attack will be preferred. However, if chemical attack is used, it is preferable to use the endless web, because it lends itself more readily to cleaning. Moreover, a chemical attack generally engenders a giving off of heat, and the low thermal inertia of a web still permits its rapid cooling after cleaning using such an attack and hence the immediate constitution of a new transfer element.

In a variant, not shown, that implements this method, the cleaning and catching means 19, 20 are present, but the remelting means are replaced with means that enable projecting the chemical agent. These means are disposed in such a way that on the one hand the chemical attack of the material 1 will be started before it comes into contact with the cleaning means in order to facilitate their action, and on the other end so that their action will be completely effective.

Nevertheless, the embodiment of FIG. 1 presents some problems of implementation. The transfer of a magnetic powdered material 1 between the drum 11 and the metallic web 2 is in fact complicated. The material in fact has a tendency to remain fixed on the drum.

Figure 2:
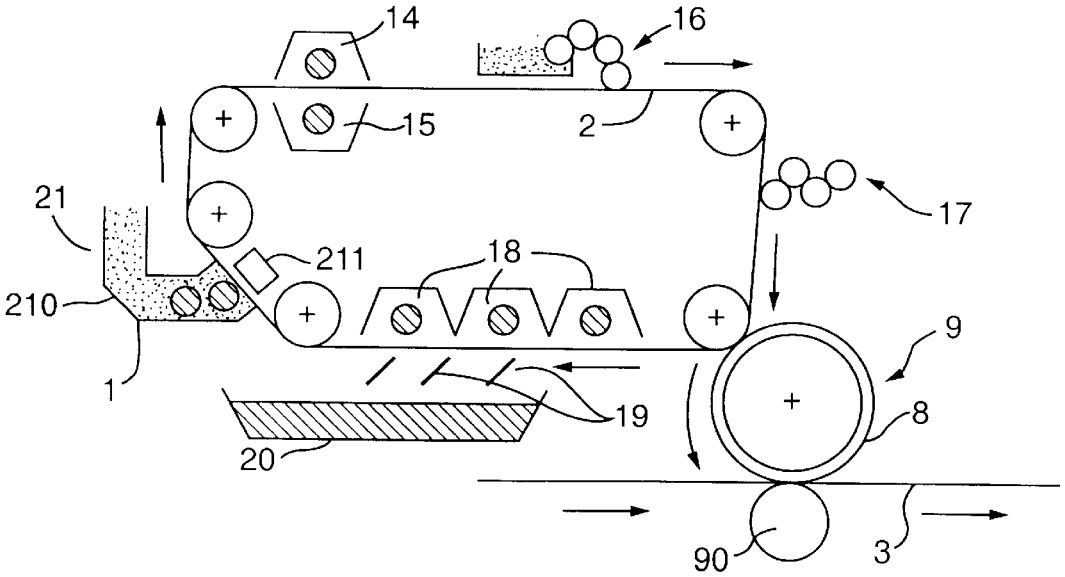
FIG. 2 shows an embodiment of the present invention.
Figure 3:
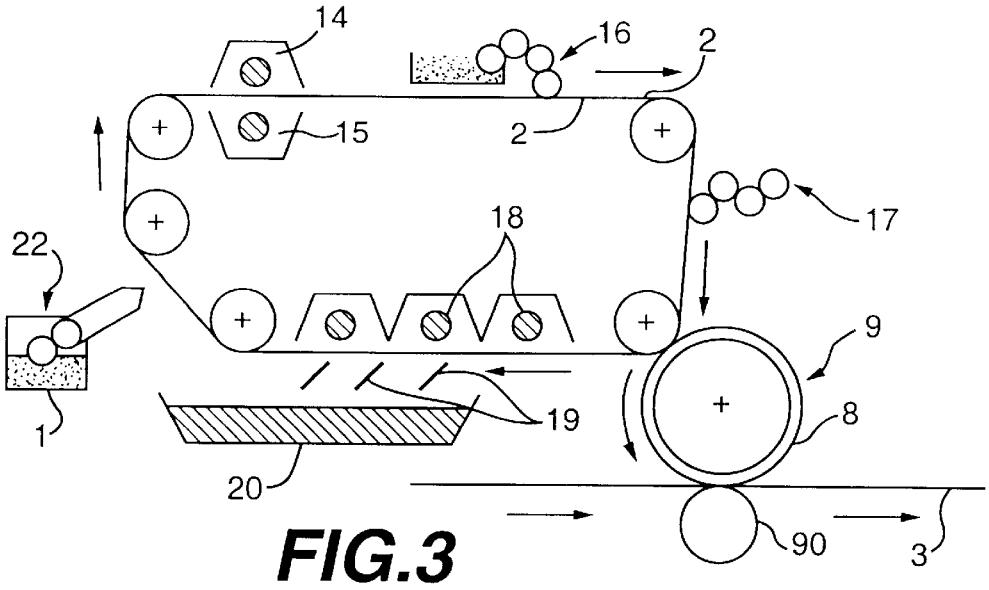
FIG. 3 shows an embodiment using an ink jet device for deposition of material on a web.

For these reasons, in variants, two embodiments of which are shown in FIGS. 2 and 3, means are provided that enable forming the image directly on a substrate such as an endless band, instead of forming it on the drum with the aid of a hardenable material before transferring it to the substrate.

The essential difference between the embodiment of FIG. 1 and the variants of FIGS. 2 and 3 resides in the device for putting the hardenable material 1 into place on the substrate formed by the thin web 2. The elements common to these various variants and their mode of operation (hardening of the material, wetting, inking, removal of material), already described in conjunction with FIG. 1, are identified by the same reference numerals and will not be described again here.

The variant of FIG. 2 allows the hardenable material 1 used to be a magnetic material that is hardenable by melting, polymerization or some other process. In this variant, the substrate formed by the endless web is a material that itself is magnetic. A device 21 for putting the material 1 into place at the appropriate regions of the web 2 is composed on the one hand of a reservoir 210 of material, placed toward the face of the web 2 in contact with the blanket 9, and on the other by an excitation device 211 with magnetic heads, placed on the other side of the web, in other words inside the space defined by the endless web, which makes it possible to selectively excite predetermined points of the web in order to attract the material 1 contained in the reservoir to those points, so as to form zones of different affinities there with respect to the colorant vehicle (ink) used. After its deposition, the material 1 is hardened, and then removed once the desired printing run has been attained.

This variant is much less expensive and much simpler to use, and it has numerous other advantages over the apparatus of FIG. 1. In particular, the excitation (writing) heads never become polluted with the material 1, and the effectiveness of deposit of the material is clearly superior, since the material is transferred directly from the reservoir to the substrate.

Instead of depositing a magnetic material, it is possible to envisage depositing any hardenable material onto the substrate formed by the web 2, under the following conditions:

its affinity for the colorant vehicle is opposite that of the substrate for the colorant vehicle;

it does not change its position between the moment when it is deposited and the moment when it is hardened;

it makes it possible to obtain very fine motifs so that the definition of the printed image will be very high.

Hence one may envisage products that are liquid, viscous or powdered at the moment they are deposited, as long as they meet the conditions that have just been mentioned.

This is illustrated by FIG. 3, where instead of showing a device for depositing a magnetic product, a device 22 has been shown whose function is to permit this deposition onto the face of the web that is toward the blanket 9. Hence the device 22 may be a jet device calibrated with liquid or viscous material, which makes excellent image definition possible. More generally, it may be an injection device adapted to the product used.

The apparatuses shown in FIGS. 1–3 enable only monochrome printing, since they include only a single press and/or inking station.

Figure 4:
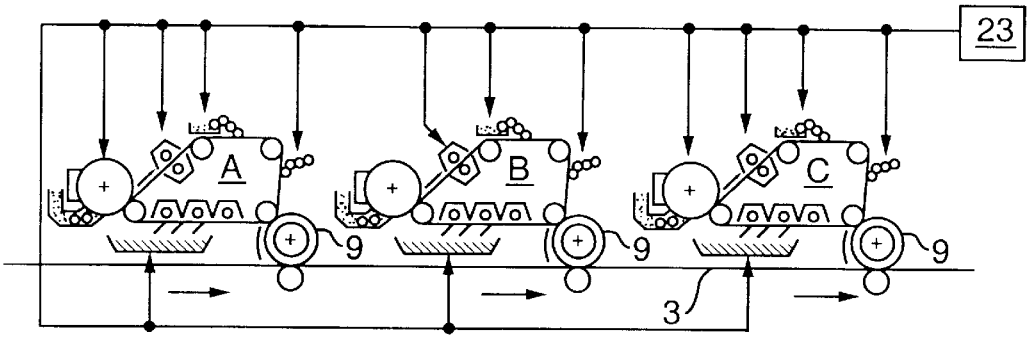
FIG. 4 shows an embodiment that enables continuous polychrome printing using three presses.
Figure 5:
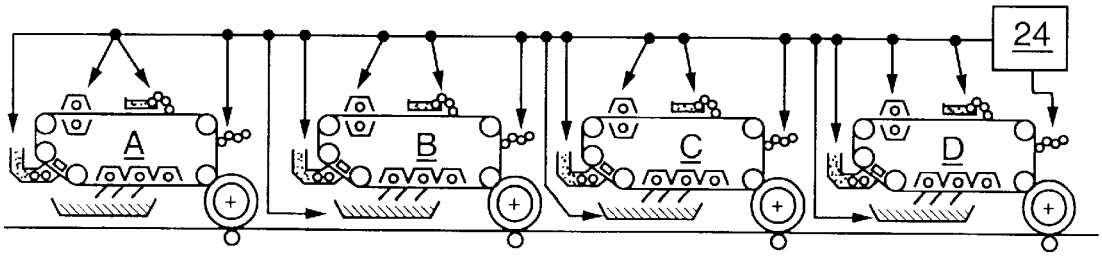
FIG. 5 shows an embodiment that enables continuous polychrome printing using four presses.

The apparatuses of FIGS. 4 and 5 enable continuous polychrome printing, that is, printing of a medium 3 that is in the form of a continuous web.

The apparatus of FIG. 4 enables continuous polychrome printing using the three basic colors (yellow, cyan, magenta) used with subtractive synthesis. This apparatus is made up of three presses A, B, C placed one after the other and driven by a single slaving and control device 23.

In the example, the three presses are identical, and each one corresponds to that described in conjunction with FIG. 1; that is, they each include one device for transferring magnetic material to their web 2 with a magnetic drum and heads for exciting the drum. It is understood that this illustration is not limiting and that the device could contain presses corresponding to those described in conjunction with FIGS. 2 and/or 3.

The first press A serves for example to print yellow motifs, the second B to print cyan motifs, and the third C to print magenta motifs. To do so, the web of paper 3 is put into contact with the blanket of each of these presses.

The sole control device 23 simultaneously drives the magnetic transfer devices of each of these presses relative to one another, so that the motifs will be correctly positioned and that the final image will be of irreproachable quality. Similarly, it drives the heating devices 14, 15, the inking and wetting devices, and finally the devices for removing the hardenable material from each of the these presses.

The variant of FIG. 5 also enables continuous polychrome printing. It shows an apparatus including no longer three but rather four presses driven by a single slaving and control device 24, and in other words makes it possible to print with the three basic colors plus black.

Hence the first press A serves for example to print the yellow motifs, the second B to print the cyan motifs, the third C to print the magenta motifs, and finally the fourth D to print the black motifs.

In the example, the three presses are identical and each corresponds to that described in conjunction with FIG. 2; that is, each includes a device for direct transfer of the magnetic material between the reservoir and their web 2. It is understood that this illustration is not limiting, and that the apparatus may contain presses corresponding to those described in conjunction with FIGS. 1 and/or 3, and may use a material that is not necessarily magnetic.

Figure 6:
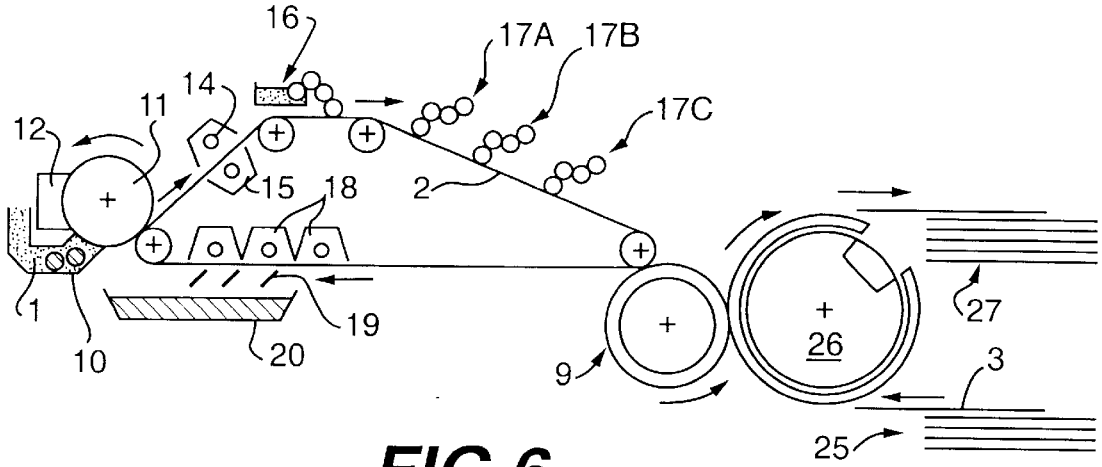
FIG. 6 shows an embodiment that enables sheet-by-sheet polychrome printing.
Figure 7:
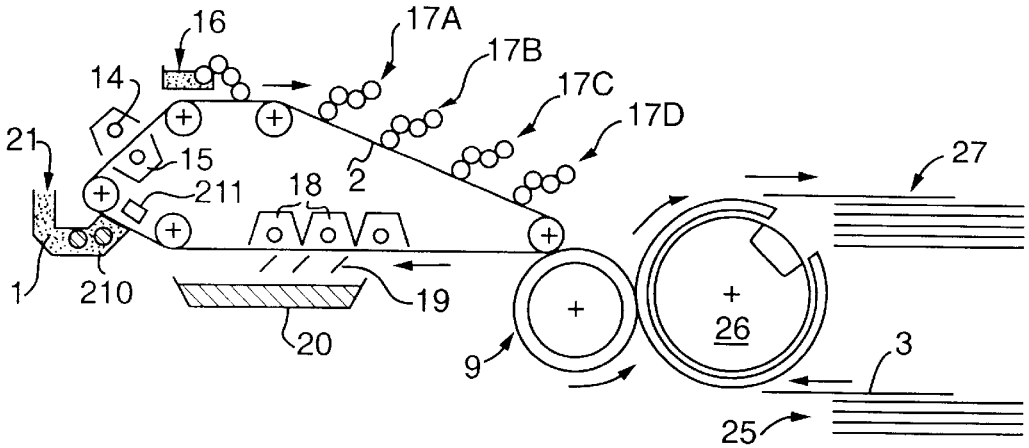
FIG. 7 shows an embodiment that enables polychrome sheet-fed printing using a blank plus three basic colors.

In FIGS. 6 and 7, presses are shown that enable sheet-by-sheet polychrome printing. These presses have minimal differences compared with those of FIGS. 1–3, with which they share the main characteristics.

In the example shown in FIG. 6, the press includes a device for transfer of the material 1 corresponding to that described in conjunction with FIG. 1, that is, a device with a drum 11 and magnetic heads 12. In the example illustrated by FIG. 7, the press includes a device 21 for transfer of material 1 corresponding to that described in conjunction with FIG. 2, that is, a device for direct transfer between the reservoir and the web 2. It is understood that these illustrations are not limiting and that any device for transfer of material described or suggested in conjunction with the description of FIGS. 1–3, and any material suitable for the transfer device employed in the press, may be used.

The press of FIG. 6 enables polychrome sheet-by-sheet printing, using the three basic colors employed with subtractive synthesis.

The essential differences between the press of FIG. 6 and the presses of FIGS. 1–3 are as follows: The press is associated with a sheet feeding device 25, known per se and not shown in detail, a sheet-carrying cylinder 26, and a device 27 for catching the printed sheets. The sheet-carrying cylinder 26 is in contact with the periphery 8 of the blanket 9, such that the rotational motion of the blanket is transmitted to the cylinder 26, making it possible to transfer the image from the blanket to a sheet carried by the cylinder 26.

The press includes a wetting station 16 and three stations 17A, 17B, 17C for inking the web 2. The inking stations are in proximity with one another.

In a preferred embodiment, the dimensions of the web are such that it is possible to constitute the basic motifs on it successively and adjacent to one another, these motifs corresponding to the separation of colors and making it possible to constitute a given image. In fact, the developed length of the web may be at least three times greater than the circumference of the sheet-carrying cylinder that determines the dimensions of the largest image that can be printed. In that case, means (not shown) for slaving and control of the press enable the selection and synchronized activation of an inking station with the passage of the basic corresponding image. On the other hand, the slaving and control means are such that the same sheet remains on the sheet-carrying cylinder for three revolutions, so that upon each revolution, one of the basic images can be printed, so that the definitive image that synthesizes the three colors will appear on the sheet at the end of these three revolutions.

The press of FIG. 7 enables polychrome sheet-fed printing, using black plus the three basic colors used with subtractive synthesis.

This press is similar to that of FIG. 6, except that it no longer includes three but rather four inking stations 17A, 17B, 17C, 17D, and preferably a web 2 whose length is at least four times greater than the circumference of the sheet-carrying cylinder. In addition, the press includes slaving and control means (not shown) arranged so that the same sheet will remain on the sheet-carrying cylinder for four revolutions, so that upon each revolution one of the basic images can be printed, so that the definitive image that synthesizes the four colors will appear on the sheet at the end of these four revolutions.

These preferred embodiments of the presses of FIGS. 6 and 7, in which the length of the web is a function of the circumference of the sheet-carrying cylinder 26, enable the same image to be printed in high numbers, which is often the case in conventional printing, by constituting the set of motifs (three or four) corresponding to each basic color of this image only a single time on the web 2, and preserving this set in proper condition until the printing run intended for that image has been completed, which makes it possible to reduce the number of remelting and cleaning operations and to attain high printing speeds.

If the length of the web is not linked with the maximum dimension of the sheets to be printed but rather is less than three or four times this dimension, depending on whether the printing is in three or four colors, then nevertheless it is possible to perform polychrome printing, but it is then necessary to clean the web one or more times during printing of each sheet, and to constitute the various motifs corresponding to the definitive image to be attained separately, which results in a time-consuming, expensive mode of operation when long printing runs are involved.

The apparatuses described in conjunction with FIGS. 1–7 lend themselves most particularly to printing with the aid of oleaginous ink or inks when the web 2 is metallic, or in other words is naturally hydrophilic (oleophobic), and the material deposited is oleophilic.

It lends itself equally to printing with the aid of an aqueous product or products, when the web 2 is metallic, or in other words naturally hydrophilic (oleophobic), and the material deposited is oleophilic, but in that case the blanket must be hydrophilic, and the motifs to be printed are made up of the zones of the web 2 that are not covered by the hardened material.

Tests have made it possible to demonstrate that magnetic toner, that is, the powdered material employed in magnetographic printers, is oleophilic. Moreover, it is known that this material is meltable. Hence it is quite particularly suitable to constitute oleophilic motifs on the metallic web, in presses using a device for magnetic transfer between the reservoir of material and the web, and fixation (hardening) and removal means with the aid of heating devices.

The presses according to the invention make it possible to obtain images of very good quality, with a print density comparable to that of lithographic presses. The quality depends actually on the means chosen for the transfer of the hardenable material to the web and on how they are used or regulated.

Hence with the variants that use a device with a jet of material, the quality depends essentially on the calibration of the jet.

Conversely, with the variants that use a magnetic transfer between the reservoir and the web, the quality depends on the relative position of the magnetic heads to one another, but also on how the press is used. In fact, because of construction constraints, a fixed spacing (pitch) of several hundred microns exists between the magnetic heads of the excitation device 12, 211. Consequently, the material is deposited as a function of this spacing, such that the image density will depend on this spacing. However, the image density may be increased considerably if the material is deposited by bringing about a plurality of revolutions of the web 2, and if upon each revolution the magnetic heads are displaced relative to the drum and hence to the web (embodiment of FIG. 1), or only relative to the web (embodiment of FIG. 2), in order to compensate for defects due to this spacing.

I claim:

1. A multi-phase printing process for printing at least one image, in a predetermined printing run, with the aid of a press by transfer of at least one colorant vehicle between an intermediate transfer element and a printing medium, comprising:

at least one phase of forming the intermediate transfer element in the press in a depositing station by depositing and fixing a hardenable material onto a substrate, the substrate and the hardenable material each having a different affinity for the colorant vehicle, such that the intermediate element includes zones having an affinity for the colorant vehicle and zones without affinity for the colorant vehicle;

said fixing of said hardenable material comprising heating said hardenable material to melt said hardenable material and subsequently hardening said melted hardenable material;

a printing phase; and a phase of dismantling the intermediate transfer element when the predetermined printing run has been completed, wherein the substrate comprises an endless web that is not removed from the press during said predetermined printing run, and that the phase of dismantling the intermediate transfer element comprises removing the hardened material from the substrate, said hardenable material being meltable after initial hardening and removing the hardenable material comprises melting the hardened material on the endless web, said endless web being constituted of a material having a thermal inertia such that, after melting and removal of the hardenable material, the endless web resumes a temperature that said endless web had prior to said removal, thereby enabling the formation of a new transfer element as soon as a part of the web on which said removal was performed crosses the depositing station, the substrate comprising a material that enables the formation of said new transfer element on a next crossing of the depositing station by the substrate after the removal of the hardened material from the substrate before the substrate crosses the depositing station.

2. The process of claim 1, characterized in that the hardenable material is chemically attackable, and the predetermined printing run includes a removal phase which consists of chemically attacking said material on the substrate which is so constituted as not to be effected by said chemical attack.

3. The process of claim 2, wherein the chemical attack on the device will be rapidly attenuated to enable the virtually immediate formation of a new intermediate transfer element after the removal of the material (1).

4. The process of claim 1, further comprising: constituting the intermediate transfer element by depositing a hardenable magnetic material onto the endless web that is not removed from the press during said predetermined run, with the aid of a magnetic transfer device including means for drawing material from a reservoir placing the material at predetermined regions of the web to constitute an image corresponding to motifs to be printed.

5. The process of claim 1, further comprising depositing, with a calibrated injection device (22), a hardenable liquid or solid or viscous material (1), having an affinity for the substrate such that it does not change position between the moment when it is deposited and the moment when it is hardened, onto the substrate, at predetermined regions of the substrate, in order to constitute an image corresponding to motifs to be printed.

6. The process of claim 1, characterized in that the material (1) is hardenable by polymerization.

7. The process of claim 1, for printing with the aid of an oleaginous ink, wherein the surface of the endless web that is not removed from the press is oleophobic, and the material deposited and hardened on this surface is oleophilic.

8. The process of claim 1, comprising the further step of chemically attacking the hardened material on the substrate, wherein the hardenable material is chemically attackable and the substrate of the press is not adversely affected by said chemical attack.

9. A printing press for implementing a printing process for printing at least one image, in a predetermined printing run, by transfer of at least one colorant vehicle between an intermediate transfer element and a printing medium, comprising:

rollers;

an endless metallic web that is not removed from the press during said printing process, said endless metallic web being carried by said rollers, said rollers being adapted to set the web into motion;

a blanket having a peripheral surface in contact with the metallic web such that when the web is in motion, the blanket is in rotation;

means for pressing a printing medium against the blanket;

means for depositing at a depositing station a hardenable material at predetermined locations on the web and means for hardening said hardenable material;

at least one station for applying a colorant vehicle onto the hardenable material after the material has hardened, in order to constitute motifs at said locations that are to be transferred to the printing medium; and means for removal and cleaning of the hardened material from the web, said web being constructed of a material having a thermal inertia enabling the formation of a new intermediate transfer element on a next crossing of the depositing station by the endless web.

10. The press of claim 9, wherein said means for hardening the material includes means for heating the material, said means for heating facing the entire width and at least one face of a small portion of the length of the web.

11. The press of claim 9, characterized in that the hardenable material (1) is polymerizable by exposing it to radiation, and it includes means (14) enabling the emission of such radiation in the direction of the entire width and a small portion of the length of the web.

12. The press of claim 9, wherein the hardened material is removed by melting, and further wherein said removal means includes heating means for remelting the material.

13. The press of claim 12, characterized in that the means for cleaning (19), comprises squeegees or scrapers disposed so that the remelting of the material (1) will be started before said material comes into contact with the cleaning means, so as to facilitate the remelting action, and removal of melted material by natural gravity.

14. The press of claim 12, wherein the hardened material can be further removed by chemical attack, and the press comprises means to project a chemical agent onto the hardened material, said means being associated with the means (19) for cleaning the material.

15. The press of claim 9, characterized in that the hardened material (1) can be removed by chemical attack and the press includes means to project a chemical agent onto the hardened material for removing the hardened material, said means for projecting a chemical being associated with means (19) for cleaning the attacked material from the web.

16. The press of claim 15, characterized in that the means for cleaning (19) comprises squeegees or scrapers disposed so that the chemical attack of the material (1) will be started before said material comes into contact with the cleaning means, so as to facilitate the chemical attack action, and removal of the attacked material by gravity.

17. The press of claim 9, further comprising transfer means for transfer of a magnetic hardenable material, said transfer means being disposed towards the face of the web onto which the material is deposited, and comprising:

a reservoir and a magnetic drum in tangential contact with the web such that displacement of the web is associated with said reservoir and a rotation of the drum, said drum being in proximity with an opening of said reservoir; and an assembly having heads for magnetization of predetermined points on a periphery of the drum positioned in proximity with the drum, wherein when a point on the periphery of the drum is magnetized by one of the heads, material contained in the reservoir is initially attracted to said point and then is transferred to the web when said point, during the rotation of the drum, comes into contact with the web.

18. The press of claim 17, further including means for displacing the assembly of magnetic heads relative to the web to compensate for spacing between the heads and to constitute high-quality printing motifs on the web.

19. The press of claim 9, characterized in that the means for depositing the hardenable material are constituted by means (22) for injection of a liquid or solid or viscous material onto one face of the web (2).

20. The press of claim 9, for polychrome printing of documents printed sheet by sheet, wherein:

said press comprises, in proximity with the web, a number n of stations for applying the colorant vehicle on the material after its hardening, equivalent to a number of basic colors required for printing, each station containing a base color different from one another;

the web having a developed length, said developed length being equal to at least n times the length of the largest document capable of being printed by the press; and slaving and control means arranged so that only one of the colorant application stations is active at a time, and so as to drive the web and the means for pressing the printing medium against the blanket such that the n basic colors required are correctly transferred to the printing medium.

21. The press of claim 20, characterized in that the means (25, 26, 27) for pressing the printing medium (3) against the blanket include a sheet feeder device (25), a sheet-carrying cylinder (26) in rotational contact with the blanket (9), and a device for catching the printed sheets, and that the slaving and control means (23, 24) are arranged so that the sheet carrying cylinder (26) executes n rotations in order to completely print one sheet.

22. The press of claim 9, for polychrome printing of documents with the aid of n basic colors for continuous printing, wherein said press includes n presses, each having a single station (17) for applying colorant vehicle, each station containing a basic color different from one another, and arranged so that the printing medium passes successively past each of said presses.

23. A printing press for implementing a printing process for printing at least one image, in a predetermined printing run, by transfer of at least one colorant vehicle between an intermediate transfer element and a printing medium, comprising a device comprising rollers, an endless metallic web carried by said rollers adapted to set the web into motion; a blanket having a peripheral surface in contact with the metallic web such that when the web is in motion, the blanket is in rotation; means for pressing a printing medium against the blanket; means for depositing a hardenable material at predetermined locations on the web; at least one station for applying a colorant vehicle onto the hardenable material after the material has hardened, in order to constitute motifs at said locations that are to be transferred to the printing medium; means for removal and cleaning of the hardened material from the web; and means for hardening the material by heating and then cooling said material, said means for heating facing the entire width of said web and comprising at least two heaters, said heaters being disposed face-to-face with one another and being positioned on either side of two main faces of a portion of the length of the web.

24. A printing press for implementing a printing process for printing at least one image, in a predetermined printing run, by transfer of at least one colorant vehicle between an intermediate transfer element and a printing medium, comprising:

a device comprising rollers and an endless metallic web made of magnetic material carried by said rollers adapted to set the web into motion;

a blanket having a peripheral surface in contact with the metallic web such that when the web is in motion, the blanket is in rotation;

means for pressing a printing medium against the blanket;

means for depositing a hardenable material at predetermined locations on the web and means for hardening said hardenable material;

at least one station for applying a colorant vehicle onto the hardenable material after the material has hardened, in order to constitute motifs at said locations that are to be transferred to the printing medium;

means for removal and cleaning of the hardened material from the web; and means for transferring the hardenable material towards a first face of the web onto which the material is to be deposited;

a reservoir in proximity with the web includes an exit opening for the material from said reservoir; and an assembly having magnetic heads for selectively magnetizing certain points on the web and attracting material to those points, said assembly being positioned face-to-face with the opening towards a second face of the web, said second face being opposite said first face.

25. The press of claim 24, further including means for displacing the assembly of magnetic heads relative to the web to compensate for the spacing between the heads and to constitute high-quality printing motifs on the web.

26. The press of claim 25, wherein the cleaning means (19), are disposed so that the remelting or chemical attack of the material (1) will be started before the material comes into contact with the cleaning means, thereby facilitating the action of the cleaning means, the action of the cleaning means being further facilitated by gravity.

* * * * *